US006092416A

United States Patent [19]

Halford et al.

[11] Patent Number: 6,092,416

[45] Date of Patent: Jul. 25, 2000

[54] DOWNHOLED SYSTEM AND METHOD FOR DETERMINING FORMATION PROPERTIES

[75] Inventors: Frank R. Halford, Scotland, United Kingdom; Walter R. Benson, Houston, Tex.; Clive P. Eckersley; Andrew L. Kurkjian, both of Sugar Land, Tex.

[73] Assignee: Schlumberger Technology Corporation, Houston, Tex.

[21] Appl. No.: 08/834,336

[22] Filed: Apr. 16, 1997

[51] Int. Cl.[7] ..... E21B 49/10; E21B 7/04

[52] U.S. Cl. ..... 73/152.23; 73/152.18; 166/264; 175/59

[58] Field of Search ..... 73/152.23, 152.18, 73/152.28; 166/264, 250.01; 175/59, 40

[56] References Cited

U.S. PATENT DOCUMENTS

| | | | |
|---|---|---|---|
| 3,969,937 | 7/1976 | Barrington et al. | 73/152.23 |
| 4,399,877 | 8/1983 | Jackson et al. | 175/45 |
| 4,635,717 | 1/1987 | Jageler | 73/152.23 |
| 4,860,581 | 8/1989 | Zimmerman et al. . | |
| 4,936,139 | 6/1990 | Zimmerman et al. . | |
| 5,337,838 | 8/1994 | Sorenson | 73/152.23 |
| 5,803,186 | 9/1998 | Berger et al. | 73/152.24 |
| 5,864,057 | 1/1999 | Baird | 73/152.23 |
| 5,922,950 | 7/1999 | Pemberton et al. | 73/152.23 |

*Primary Examiner*—Hezron Williams
*Assistant Examiner*—J. David Wiggins
*Attorney, Agent, or Firm*—John J. Ryberg; Brigitte L. Jeffery; Steven L. Christian

[57] ABSTRACT

In this invention, drill pipe or tubing is attached to a sampling tool that is suspended in a borehole. A wireline cable also connects the tool to surface equipment and establishes electrical communication between the tool and the surface equipment. A valve located in the docking head assembly controls fluid flow between the borehole and the drill pipe through a port located within the drill pipe assembly which is opened and closed as required. During operations, the tool takes fluid samples from the formation and analyzes them for contamination levels. Unacceptable fluid is pumped or flowed through the tool via a flowline and into the drill pipe where it is stored until it is disposed of at the surface. Once the flowing fluid reaches acceptable levels of contamination, this fluid is pumped or flowed into a sample chamber(s) in the tool. Once sampling is completed the contaminated fluid is forced to the surface by opening the port and pumping a different fluid down the borehole annulus, through the port and into the tool below the contaminated fluid and thereby filling the drill pipe and forcing the contaminated fluid up the drill pipe and to the surface, instead of discarding the fluid into the borehole or storing the fluid in the tool. This invention allows for larger amounts of fluid to be retrieved from the formation which results in cleaner fluid samples and better information about the formation. Moreover the nature of the pressure data acquired both during periods of flow and shut-in can be used to deduce formation permeability and permeability anisotropy.

20 Claims, 4 Drawing Sheets

DOWNHOLED SYSTEM AND METHOD FOR DETERMINING FORMATION PROPERTIES

FIELD OF THE INVENTION

The present invention relates to a downhole wireline method and system for measuring and determining formation properties. In particular, it relates to a system and method for taking formation and analyzing fluid samples. This invention incorporates drill pipe or jointed tubing as part of the system and uses the drill pipe/ tubing in the measurement and sample taking process.

BACKGROUND OF THE INVENTION

Presently, downhole wireline tools exist that are capable of making formation pressure measurements useful in calculating formation permeability. U.S. Pat. No. 4,860,581 to Zimmerman, discloses a downhole tool of this type that can take formation fluid samples and determine formation properties. A tool of this type usually incorporates the features of a straddle packer to allow formation fluid specimens to be taken at larger flow rates than possible through a probe without lowering the pressure below the formation fluid bubble point. When used in combination with a pressure probe, the tool can obtain more meaningful permeability readings and at larger depths of investigation than previously permitted with other known tools. Additionally, these tools allow flow measurement and flow control during the creation of a pressure pulse which enhances the permeability determination. These downhole tools may be modularly constructed so that a tool can perform multiple tasks in a single descent of the tool into the borehole. Such tasks can include: a pressure profile of the zone of interest, a fluid analysis can be made at each station, multiple uncontaminated fluid samples can be withdrawn at pressures above the bubble-point, local vertical and horizontal permeability measurements can be taken at each station, a probe module can be set at a location dictated by previous measurements and the tool can perform large scale pressure build up tests.

As shown in FIG. 1, a downhole tool 1 is suspended in a borehole 13 from a wireline cable 2. A probe module 3 establishes fluid communication between the tool and the earth formation via a probe 4. This tool contains a pump module 5 for pumping contaminated fluid from the formation into the tool and a means to analyze fluid from the earth formation, both of which are described in U.S. Pat. No. 4,860,581. As shown, both contaminated fluid 6 and clean fluid 7 are located in the formation. Contaminated fluid 6 is in closer proximity to the borehole and is usually pumped out before the desirable fluid 7. From the fluid analyzer, it is determined whether the pumped fluid is undesirable contaminated fluid 6 or the desirable less/uncontaminated reservoir fluid 7. This less contaminated fluid is often referred to as the 'clean' fluid. Drilling fluid (mud) 8 fills the annulus of the borehole. As known, one purpose of this mud is to control subsurface borehole pressure and stabilize the borehole to prevent formation pressure from exceeding the borehole pressure and causing a well blowout to occur. The tool 1 also contains a sample module 9 where the desired fluid sample is stored and electronic 10 and hydraulic 11 modules that supply electronic and hydraulic power respectively.

U.S. Pat. No. 4,936,139 issued to Zimmerman, describes a method for making formation pressure measurements and taking formation samples using the above-described downhole tool. In this method, a probe 4 in fluid communication with the tool body is also in contact with the borehole wall

12. To retrieve the formation fluid, a pressure drop is created in tool. This pressure drop causes formation fluid to flow from the high pressure formation to the lower pressure probe and into the tool. As previously mentioned, the formation contains various types of contaminated, undesirable and potentially hazardous fluids 6. These fluids also flow through the probe and, because these fluids are closer to the borehole and tool probe, these fluids are produced first. This initial production of contaminated fluids means that the contaminated fluid has to be pumped out of the tool before the clean formation fluid can be sampled.

In current sampling tools, the contaminated fluid is pumped into the tool and analyzed. The analysis would show that this fluid is contaminated and therefore, undesirable. Consequently, the tool pumps this fluid out of the tool and into the borehole or a dump chamber usually located at the lower end of the tool. This process continues until the tool begins to analyze clean, less contaminated reservoir fluid. At this point, the clean sample is stored in a pressurized chamber 9. However, before the tool begins to analyze the cleaner desirable fluid, a large volume of contaminated fluid will usually need to be pumped from the formation through the tool, or placed into chambers carried as part of the tool. The present system frequently cannot in practice remove sufficient quantities of fluid to ensure a clean sample. Therefore, the actual formation sample fluid still contains some contaminated fluid.

The degree of contamination that is acceptable depends upon a variety of factors:

1/ The use to which the sample analysis will be put. Some uses are not so sensitive to contamination as others, in so far as the resulting data from the sample analysis is less affected by contaminating fluids. This depends upon the type of analysis that is performed upon the samples.

2/ The nature of the reservoir fluid. It has been found that the Pressure Volume Temperature behavior (PVT) of some reservoir fluids, typically oils with large volumes of gas dissolved within the oil, or gases with the potential to produce relatively large volumes of liquid when the pressure on the system is reduced, is much more sensitive to contaminating fluids than other reservoir fluids.

Two major drawbacks are associated with this fluid sample taking process. One problem is that storing the fluid in a dump chamber limits the amount of contaminated fluid, drawn from the formation, to the size of the chamber. Additionally, the weight of the chamber full of fluid creates extra tension on the wireline which could limit the amount of tension that could be exerted on the wireline. This limitation would be critical for instance if the tool became stuck in the borehole and only a limited amount of force or tension could be exerted on the tool to loosen the tool. A second and even greater source of concern is the alternative, to a storage tank, of dumping the contaminated fluid into the borehole. In the current operation of this tool, only a few gallons of the contaminated formation fluid can be dumped into the borehole, before safety issues may arise.

By putting contaminated fluid in the borehole, there will be a mixing of the fluid with the drilling mud in the borehole. As previously stated, the weight and consistency of the drilling mud is such that the borehole pressure is maintained at a pressure at least equalizing that of the formation. If too large a quantity of formation fluid mixes with the drill mud, the borehole fluid weight and consistency could be altered such that the borehole pressure would drop below the formation pressure substantially increasing the possibility of a well blowout. Another safety issue resulting from dumping contaminated formation fluid in the borehole is that some of these fluids contain hazardous components. Since drill mud is circulated from the surface into the borehole and back to the surface, the potential for hazardous fluid components increases with more and more contaminated fluid being into the borehole. If some of these fluids reached the surface, there could be safety problems for persons at the surface. Therefore, because of problems associated with disposing of contaminated formation fluids in the conventional method of sample taking, the amount of fluid taken during a sampling procedure is limited. Furthermore, the limit on the amount of fluid that can be produced limits the amount and quality of clean formation fluid that can be sampled. If a means existed that would allow for taking a greater quantity of formation fluid without having the problem of where and how to dispose of the unwanted contaminated fluid, cleaner and better quality uncontaminated fluid samples could be taken. Cleaner samples would permit better analysis of the fluid sample and give more representative information about the formation fluids. There remains a need for a means to allow for the disposition of a sufficient amount of contaminated formation fluids during a sample taking procedure such that a sufficiently clean uncontaminated formation fluid sample is collected.

Drillstem Test (DST)

DRILLSTEM testing is another technology that is used to take a fluid sample from a formation. DRILLSTEM testing is a method used to temporarily complete a recently drilled well in a formation in order to evaluate the formation. The test can be made either in an open hole or in a cased hole with perforations. A flow string, usually a drill string of pipe, or sometimes a tubing string is used to carry the test equipment into the well. The test equipment can include packer(s), perforated pipe, pressure gauges, and a valve assembly. Packers are used to isolate the formation from drilling-mud pressure. A hook-wall or casing-packer test is used in a cased well. An openhole, single packer test with one compressional packer can be used when the formation is on or near the bottom of the well. An openhole, double-packer, or straddle-packer test with two packers is used when the formation is located off the bottom of the well. A cone-packer test is used over a conehole and a wall-cone packer test is used over a cone hole with a soft shoulder.

During the test, formation fluids are allowed to flow into the drillstem, and a sampling chamber is used to collect less contaminated formation fluids. A pressure gauge and recorder is used in the drill string to record well pressures. The time of the test is limited by the data storage capacity of the downhole recorder. The test is run for periods ranging from hours to days. The important measurements in these tests are: a) initial hydrostatic pressure, b) initial flow pressure, c) initial shut-in pressure, d) final shut-in pressure, e) final flow pressure and f) final hydrostatic pressure. The shut-in pressures are recorded on a pressure build-up curve.

The drillstem test is frequently run in four steps. There is a short initial flow (IF) period in which the tool is opened. The tool is then shut in for the initial shut-in (ISI) that may last twice as long as the flow period while the bottom hole pressure is recorded along with surface shut-in and flowing pressure. The tool is then opened again for the main flow (MF) while the flow rates, pressures and volumes are measured. The flow rates are controlled by an adjustable choke. The sample of the formation fluids is collected during such a flow period. During the final shut-in (FSI), the tool is closed. If liquid did flow to the surface, it is sent to a separator where the gas, oil and water are separated. The gas is metered and the liquid flows gauged. The fluid flow rate through the choke is reported. If the fluid does not flow to the surface, the driller measures the height of liquid in the drillstem by counting the stands of pipe in the derrick, or by other means. The test determines the type of fluids in the formation and the formation productive capacity. Pressure records made during the drillstem test are used to calculate formation pressure, permeability and the amount of formation damage. Such a system has been used for many years by the industry. It is however costly to use and has certain drawbacks:

1/ Some means of disposal of the produced fluids is necessary, often this is by burning, with associated pollution risks.

2/ Burning makes it very difficult to maintain well operations confidential. The flare can be seen for many miles, and indicates to a trained observer, the nature of the fluid produced and the approximate production rate attained.

3/ The operation is by its very nature, hazardous. Whilst flowing hydrocarbons to surface, on a drilling rig, it is necessary to temporarily adapt the drilling rig to become a production installation.

4/ The productive capacity estimated during such a test serves only as a guide to how a well, drilled and completed as a producing well, may actually perform.

5/ Samples obtained during such a test may not be representative as often it is necessary to sample fluids with a high degree of control over the pressure drawdown. This is not always possible during a DST.

6/ It is costly to test, and often a well encounters more than a single productive interval. In practice many productive intervals are not tested because of the associated cost.

7/ DST rarely provide complete information upon the drainage volume into which the well is placed. Such tests normally must be ran for a much longer duration (weeks or months) than a conventional DST.

The DST therefore is not always the best solution to meet the differing requirements for data to evaluate a well, or reservoir.

Tough Logging Conditions (TLCS)

In the past, wireline logging tools have been extended into a borehole on drill pipe. This system is known as Tough Logging Conditions System (TLCS). TLCS is a logging tool conveyance method. This method is designed to transport well logging tools into wellbores which cannot be entered using a conventional wireline cable gravity descent. A TLCS can be used to convey a well logging tool or mechanical service normally conveyed on a wireline into a wellbore for the purpose of acquiring geological, petrophysical data and/or to perform other services. The TLCS method uses drill pipe that is attached to a logging tool to push the logging tool into the wellbore. The wireline containing the means for communication between the tool and surface equipment is contained in the drill pipe. A logging run begins by adding drill pipe to a drill stand that is attached to a downhole tool to log down and subtracting drill pipe from the drill string to log up the borehole.

TLCS is necessary for logging in wellbores which generally have a well geometry that includes deviations up to and over 90 degrees from the vertical. However, the TLCS is also used to log wells which are vertical, but have obstructions in the wellbore preventing a normal gravity descent for logging tools conveyed on a wireline. Furthermore, TLCS have logging applications in depleted wells where a high differential pressure exists between the wellbore and the geological formation. This conditions may cause the wireline and/or the logging tools to become stuck against the formation resulting in a fishing job.

SUMMARY OF THE INVENTION

An objective of this invention is to reduce the levels of contamination of fluid samples by flowing larger volumes of fluid than is practically feasible with standard sampling tools.

Another objective of this invention is to use drill pipe or other means that supports a sampling tool as a storage means for undesirable contaminated fluids.

The present invention provides a system that performs formation analysis and collects cleaner formation fluid samples than previous sampling tools. This invention incorporates certain features from the DST and TLCS methods into a novel downhole tool system for taking formation pressure measurements and formation fluid samples. This system contains a downhole sampling and testing tool suspended in a borehole by a support means, usually a drill pipe or coiled tubing. For purposes of this disclosure, drill pipe will be the support means. The drill pipe is connected to the testing tool by a connector containing both electrical connections and pressure tight flowline connector to join the tool flowline to the drill pipe assembly. A wireline for supplying power and control from the surface to the testing tool is contained in the drill pipe. The sampling tool can contain a probe, flowlines, an expandable dual straddle packer, a fluid analyzing means and sample chambers for storing formation fluid samples. Furthermore, the flowline can be placed into direct communication with the drill pipe. In the operation of the present invention, the sampling tool is lowered into the formation on a drill pipe string. A dual straddle packer module or a probe in the tool is set against the borehole wall and is in communication with the formation fluids. Pressure inside the tool and pipe is lowered below the formation pressure which causes the formation fluid to through the dual packer module or probe and into the tool. The fluid is analyzed to determine its contamination content. The substantially contaminated fluid is channeled through the tool and into the drill pipe. It should be noted that the drill pipe or tubing assembly may include drill pipe jars, sample chambers, slip joints and circulating valves.

In the present invention, the drill pipe or tubing serves as a storage chamber for the undesired contaminated formation fluid. Because the drill pipe serves as this storage chamber, substantially more fluid can be pumped out of the formation, in order to get a cleaner fluid sample, without increasing the risks of decreasing the borehole pressure from the formation fluid when fluid is disposed into the borehole. In addition, the drill pipe supports the tool, eliminating the concern over supporting the weight of the stored fluid with a wireline. The system continues to pump or flow fluid from the formation and into the tool and pipe, analyze the fluid and store contaminated fluid in the drill pipe until fluid of a previously determined, acceptable level of contamination begins to flow through the analyzer.

It is anticipated that in the present invention volumes of fluid of the order of 5–10 barrels will be flowed into the drill pipe/tubing before samples are taken. Currently, approximately 10 to 13 gallons of fluid can flow into the tool before a sample is taken. These volumes are relatively small compared to most tubing capacities and will not create large pressure differences between the pressure within the drill pipe/tubing and the space outside of the drill pipe within the borehole. In some cases it may be judged feasible to flow formation fluids a substantial way up the drill pipe, or even to surface, but this most likely would only be attempted once sufficient experience had been acquired using the invention to flow limited volumes of the order of 5–10 barrels, as previously stated.

At this point, the desired formation fluid is channeled into a sample storage chamber. After the sampling procedure is completed, the unwanted fluid stored in the drill pipe chamber can be disposed of before the sampling tool is brought to the surface. The disposal of the unwanted contaminated fluid is necessary for safety reasons. The composition of the contaminated fluid is unknown and could contain chemicals that are harmful if not properly handled. The present invention also provides a means to channel the contaminated fluid to the surface for disposal. A fluid is pumped down the borehole annulus alongside the drill pipe through a drill pipe port, comprising a dedicated circulating mechanism which is part of the drill pipe/tubing assembly, and into the drill pipe at a point below most of the contaminated fluid. The fluid in the drill pipe/borehole annulus forces the contaminated fluid up the drill pipe to the surface where it will be directed through conventional surface equipment and wellhead pressure control equipment to purpose designed tanks for later disposal.

This invention can also enable the testing and sampling tool to operate satisfactorily in non-vertical wells. Because the sampling tool can be connected to pipe instead of a wireline, force can be exerted on the pipe to cause the tool to move through a non-vertical borehole, especially a horizontal borehole. Standard wireline logging jobs in a vertical borehole rely on gravity to supply force for moving the tool through the borehole. In horizontal wells especially, gravity is not available. In addition, force cannot be exerted on a wireline for the purpose of moving a tool through a non-vertical borehole. The drill pipe string has enough stiffness to withstand a force that will cause a tool to move in a non-vertical borehole or to move pass obstructions or deviations in a well.

DETAILED DESCRIPTION OF THE INVENTION

Figure 1:
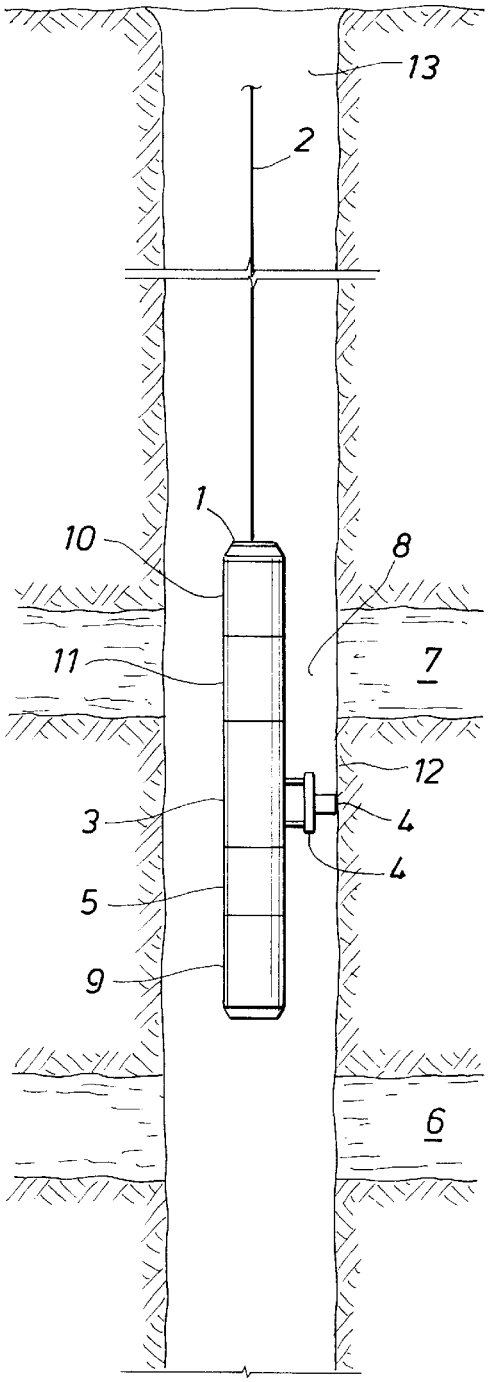
FIG. 1 (PRIOR ART)
FIG. 1 Diagram of a conventional Formation Tester tool.
Figure 2:
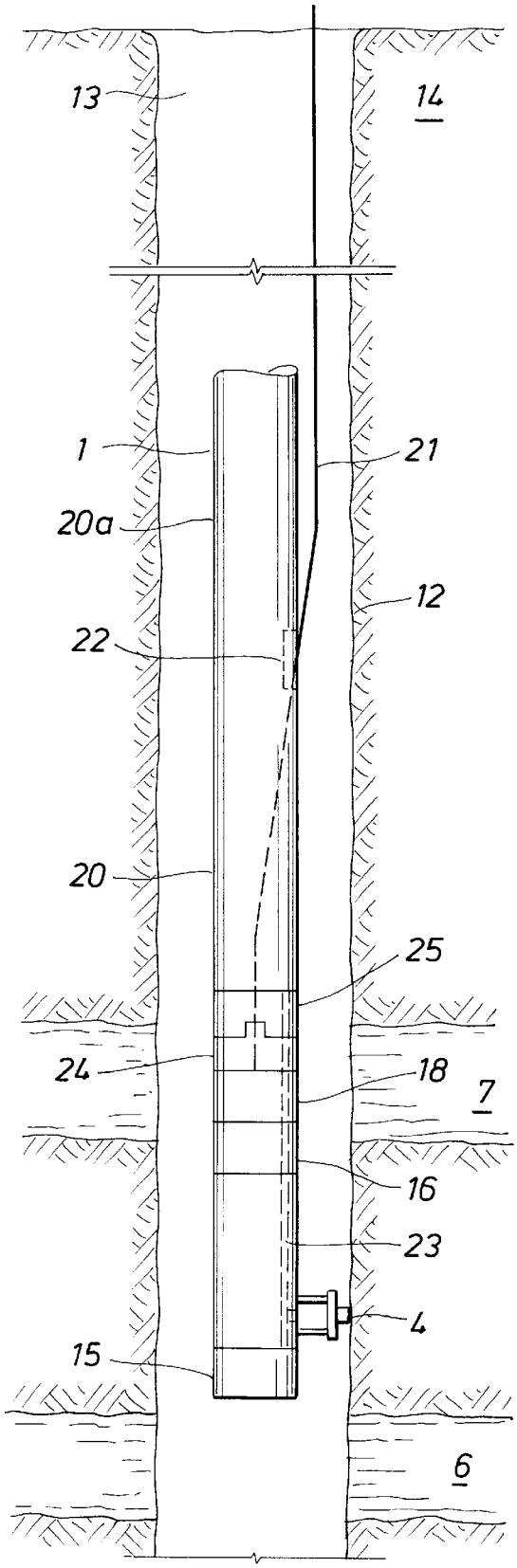
FIG. 2 Diagram of the System of the present invention deployed in a borehole.

The present invention provides a system that performs formation analysis and collects cleaner formation fluid samples than previous sampling tools. This invention incorporates certain features from the DST and TLCS methods into a novel downhole tool system for taking formation measurements and fluid samples. FIG. 2 shows an embodiment of the system of the present invention. As previously described in FIG. 1, a conventional sampling tool 1 is deployed into a borehole 13 that traverses an earth formation 14 to perform logging tests. The tool in FIG. 2 contains a probe module 4 that is set in contact with the borehole wall 12 and establishes fluid communication between the formation 14 and the tool 1. A sample storage chamber 15 is located below or above the probe. A pump or flow means and fluid analyzer are also incorporated in the tool as described in FIG. 1, but are not specifically identified in FIG. 2. The pump can be used to remove unwanted contaminated fluid from the formation through the tool before retrieving cleaner uncontaminated fluid. The pumped in formation fluid is analyzed for contamination content using a fluid analyzer.

It is also possible to flow fluid through the tool without the use of the pump. The drill pipe can be ran to a given depth above the test interval with the circulating valve open. The valve can then be closed before running to test depth. In this way the pressure exerted by the column of fluid enclosed within the drill pipe can be preset to a value less than the pressure within the formation. Once the Dual Packers are set, and the tool opened it is possible to regulate, or throttle the flow from the higher pressure formation, through the tool and into the lower pressure drill pipe/tubing by using valves and pressure gauges within the tool. This procedure is known as 'Setting the Cushion' and is commonly used to initiate a DST.

Once flow has been initiated, the surface fluid displaced can be measured to determine the volume of fluid influx from the formation, through the tool into the drill pipe. This is important, as it provides a surface control over the amount of reservoir fluid and contaminants that can enter the drill pipe/tubing. Under normal operations, the influx is regulated by the tool, and flow is stopped by closing a valve within the tool. It will always be possible to stop flow by closing the valves at surface and downhole in the event of a tool valve failure. The downhole valve will be part of the drill pipe/tubing assembly and is a standard item used in DST.

The analyzer can determine fluid content by measuring certain fluid properties such as receptivity and optical absorption of specific wavelengths of light. Attached to the top portion of the tool is a telemetry module 16 for transmitting data from the downhole tool to surface equipment. A power cartridge 18 supplies power to the from the surface to the tool. The power cartridge also contains a flowline that connects the tool flowline to the drill pipe inside volume.

In FIG. 2, a drill pipe or tubing stand 20 is attached to the downhole tool 1. In the present invention, the tool is lowered into the borehole by stands of drill pipe 20*a* instead of solely by a wireline 21. The drill pipe stands are connected to each other and extend the tool into the borehole similar to the TLCS method. In the present invention, the drill pipe stand 20 and 20*a* serves as a storage chamber for contaminated formation fluids that are retrieved from the formation during the sample taking process. One stand of the drill pipe can contain a side-door sub 22. The side-door sub is a tubular device with a cylindrical shape and has an opening on one side. The side opening allows a wireline to enter/exit the string of drill pipe, thereby permitting the drill string strands to be added or removed without having to disconnect (unlatch and latch) the wireline from surface equipment.

The side-door sub provides a quick and easy means to run the drill pipe/tubing to test depth without having to unlatch the wireline from the tool. However, the side-door sub is not critical to this invention. Furthermore, in certain situations, it may be necessary to dispose of the side-door sub for the following reasons:

1/ Complete pressure integrity of the drill pipe is judged necessary.

2/ A quick means to disconnect the drill pipe from the rig is required at the level of the sub-sea blow-out preventers (BOP's). This is commonly required in the case of floating drilling rigs. This is performed with a special device that is set within the BOP's that connects the drill pipe in the well, beneath the BOP's to the pressure tight pipe running from the BOP's to the floating rig itself. The device may be disconnected within a period typically of the order of 1–2 minutes, allowing the floating rig to be quickly moved from its initial position over the sub-sea BOP's. If such a device is required, it will be necessary to run the electrical cable that connects to the tool through the inside of the complete length of pipe from rig to the tool, dispensing with the side-door sub completely.

A flowline 23 runs throughout the portions of the downhole tool 1 including the telemetry and power cartridges. These flowlines allow fluids from the formation to flow to the various portions of the tool as necessary or to flow through the tool and into the drill pipe 20.

Figures 3, 5:
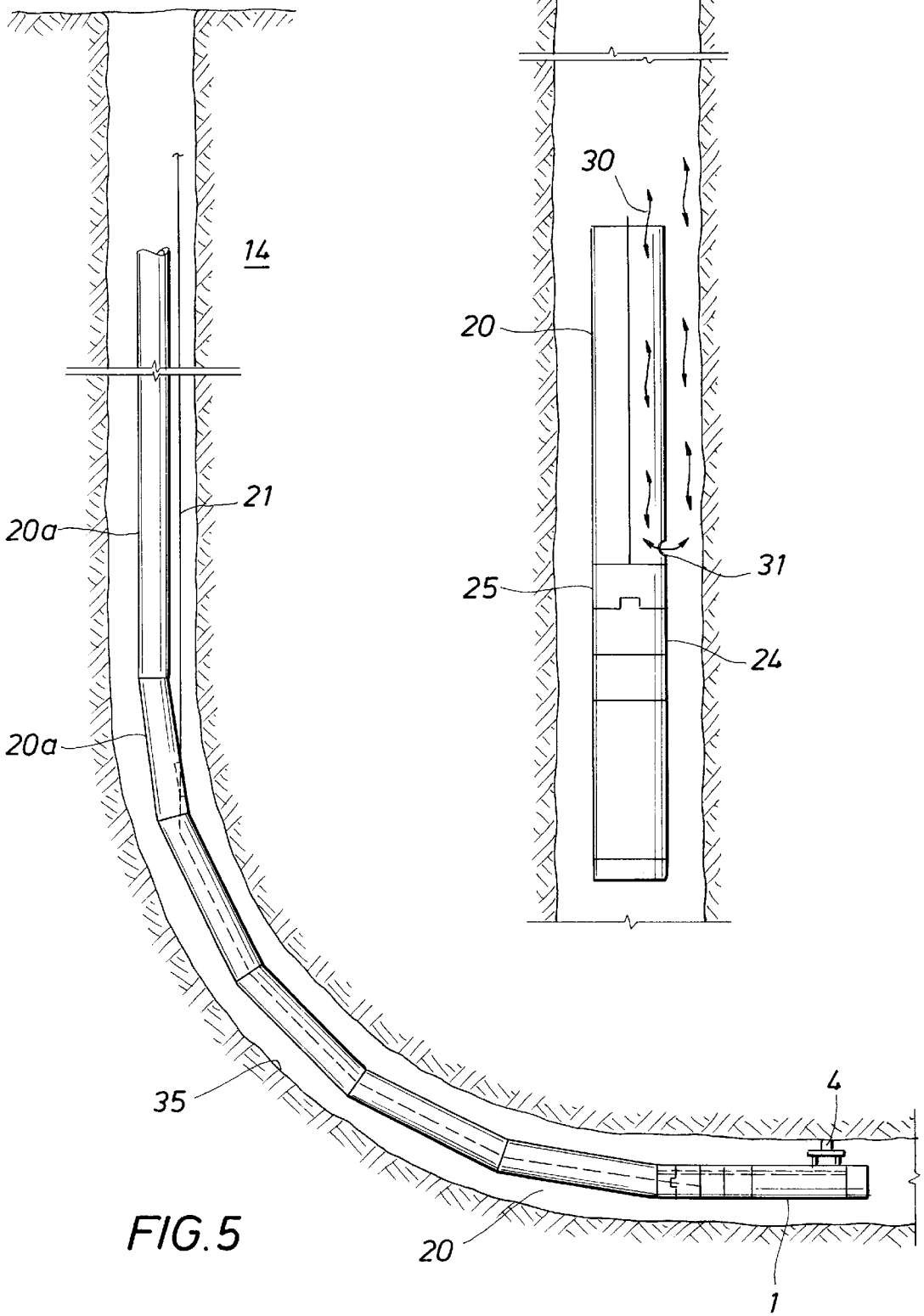
FIG. 3 Diagram of the forward and reverse flow circulation.
FIG. 5 is a diagram of the present invention in a horizontal well.

This invention contains a means to connect the downhole tool to the wireline and establish communication with the surface equipment. As shown in FIG. 3, a downhole electrical assembly 24 is attached to the electrical cartridge 18. The downhole electrical assembly can contain the electrical contacts or a male contact assembly, a latching assembly and ports for mud circulation. A pumpdown electrical contact 25 is connected to the wireline 21. The pumpdown electrical assembly contains the female contact array and is connected to the wireline. The pumpdown electrical contact engages the downhole electrical assembly 24 to establish communication through the wireline. As will be discussed herein, circulation ports are part of a special sub assembly, forming part of the drill pipe/tubing assembly to facilitate forward and reverse circulation of drilling fluids into and out of the drill pipe during system operations.

In the operation of the present invention, a downhole testing tool 1 is attached to the bottom end of the downhole electrical assembly 24 via normal logging tool connections. Drill pipe 20 is attached to the upper end of the downhole electrical assembly. Testing tools are conveyed into the borehole, on the drill pipe, down to the desired testing location in the borehole. The pumpdown electrical assembly 25 is placed in the drill pipe and attached to the wireline 21. The side-door sub is then placed on the drill pipe string, if required. The wireline is extended through the sub and into the borehole. The system will use drilling mud 30 to pump down the electrical assembly through the drill pipe. The use of drilling mud requires mud circulation equipment. This circulation equipment is attached to the drill pipe string above the side-door sub portion of the drill string. Once the pump down electrical assembly 25 is inside the drill pipe, it is simultaneously pumped (with drilling fluid) through the drill pipe until the pump down electrical assembly latches and is locked to the downhole electrical assembly.

The mud that is circulated down the drill pipe/tubing to push the connector into place is circulated through the circulating ports, referred to above, and returned to surface through the drill pipe/borehole annular space. With the two electrical assemblies latched and locked together, the electrical contacts of the two assemblies are properly aligned. The wireline is now effectively connected to the downhole tools. The downhole tools are now powered up to begin operations.

As previously stated, the pump down electrical assembly 25 is lowered into the drill pipe for contact with the down hole electrical assembly using drilling fluid. As shown in FIG. 3, drilling fluid 30 is pumped down the drill pipe 20. The drilling fluid forces the pump down electrical assembly 25 down the drill pipe and returns to surface through the open circulating ports. Known means inside the drill pipe keeps the pump down assembly aligned with the down hole assembly 24 such the latching procedure is smooth. As stated above, the drilling fluid is pumped down the drill pipe, and exits the drill pipe the port 31. The port is open during circulation procedures and is closed during tool operations. The ability to close the port enables the drill pipe pressure to be adjusted to a desired pressure just above the tool. It is important to be able to vary the pressure as necessary when moving the tool throughout the borehole. The ability to close the port prevents the port from being clogged with debris from the borehole. Debris that clogs the borehole can restrict the ability to vary drill pipe pressure as the tool experiences pressure changes in the borehole and earth formation.

Referring to FIG. 2, formation fluid flows into the tool through the probe (or packer module) 4. A pressure difference created in the tool, either by using the pump, or by presetting the cushion (referred to above) causes formation fluid to flow through the packer module into the tool. As shown in FIG. 2, the formation contains the desired uncontaminated fluid 7, but also contains unwanted contaminated fluid 6. In addition, the contaminated fluid is closer to the borehole and tool than the desired fluid. Consequently, the contaminated fluid tends to flow through the dual packer and into the tool before the desirable fluid. Therefore, in order to get a desired fluid sample the contaminated fluid must be pumped or flowed from the formation before a sample can be taken. As stated earlier, large quantities of this fluid cannot be stored in conventional sampling tools. Large quantities of the fluid can not be dumped in the borehole either. In this invention, the drill pipe string 20 and 20*a* serves as chamber in which to store unwanted formation fluids. The fluids are taken in through the packer module and analyzed. If the fluid contains unacceptable amounts of contamination the fluid is pumped through the flowline 23 into the drill pipe string. Because of the length of the drill string, much larger quantities of contaminated formation fluid can be sampled and stored without creating the aforementioned problems associated with taking samples using existing sampling tools. As the fluid is pumped into the tool and analyzed, the analyzer will begin to measure properties of the desirable formation fluid. At this point, the clean formation fluid is pumped into the storage chamber 15. The tool can have several sample chambers as is the case in some conventional sampling tools. Moreover, if a probe is set some distance from the dual packer module, the pressure observed at the probe may vary as fluid is withdrawn from the formation into the tool. The nature of the pressure changes both at the packer module and the observation probe provide independent estimates of formation permeability, damage and formation permeability anisotropy.

After the sampling procedure is completed, the unwanted fluid stored in the drill pipe chamber can be disposed of before the sampling tool can be brought to the surface if necessary. The disposing of the unwanted contaminated may be necessary for safety reasons. The composition of the contaminated fluid could be unknown and could contain chemicals that are harmful if not properly handled. Well sites usually have equipment available that is designed to handle hazardous materials.

The present invention provides a way of disposing of the contaminated fluid by pumping a different fluid down the borehole annulus, through the port 31 and into the drill pipe. The contaminated fluid above the port is forced upward by the fluid entering through the port. As more fluid enters through port 31, the contaminated fluid is forced upward to the surface. Surface equipment is available that is designed to handle the hazardous materials. Fluid continues to be pumped into the drill pipe until the amount of contaminated fluid remaining in the drill pipe is below the hazardous levels. Another method of retrieving is to create a pressure drop in the chamber above the stored fluid. This pressure drop would cause the fluid to flow upward to the surface and be captured by the surface equipment designed to handled such fluid.

Figure 4A:
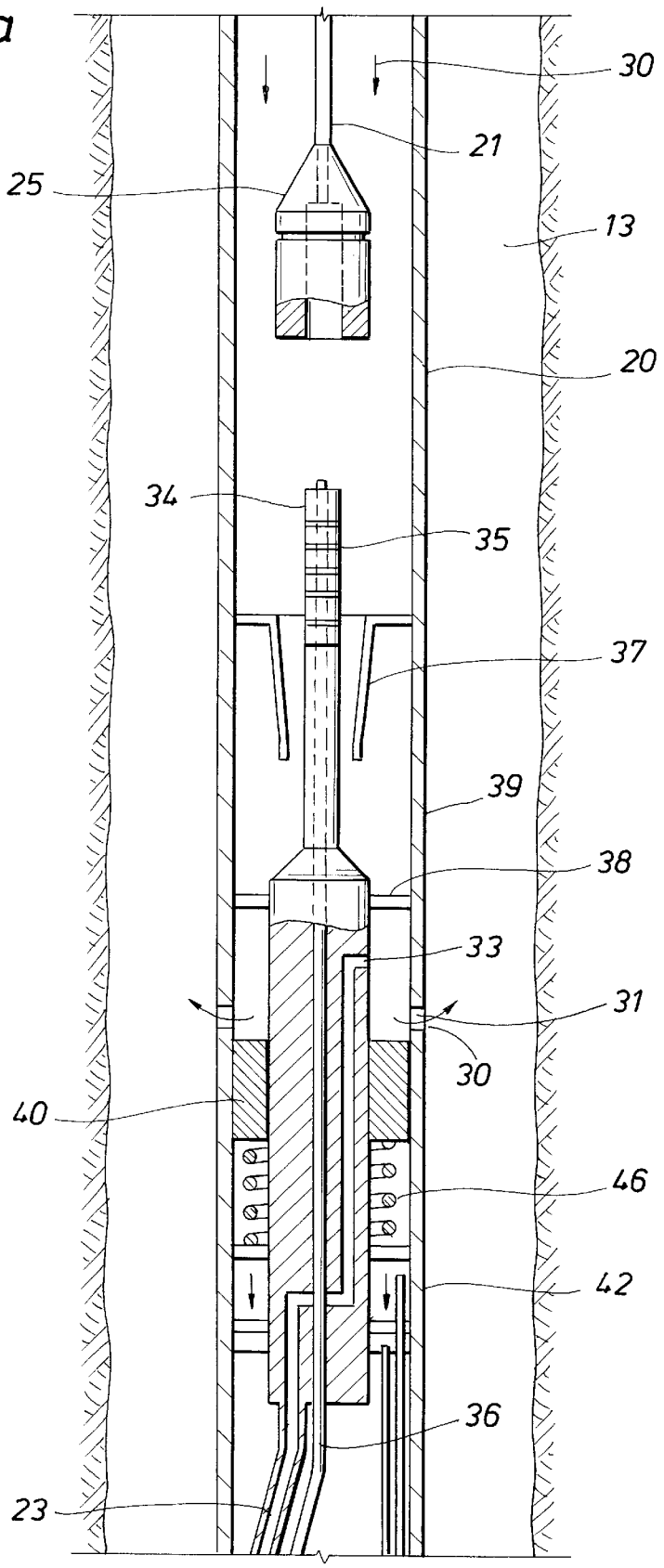
FIG. 4 is a schematic of an embodiment of the invention in which communication is established between the sampling tool and the surface by pumping down an electrical assembly to engage and latch with an assembly that is connected to the sampling tool.
Figure 4B:
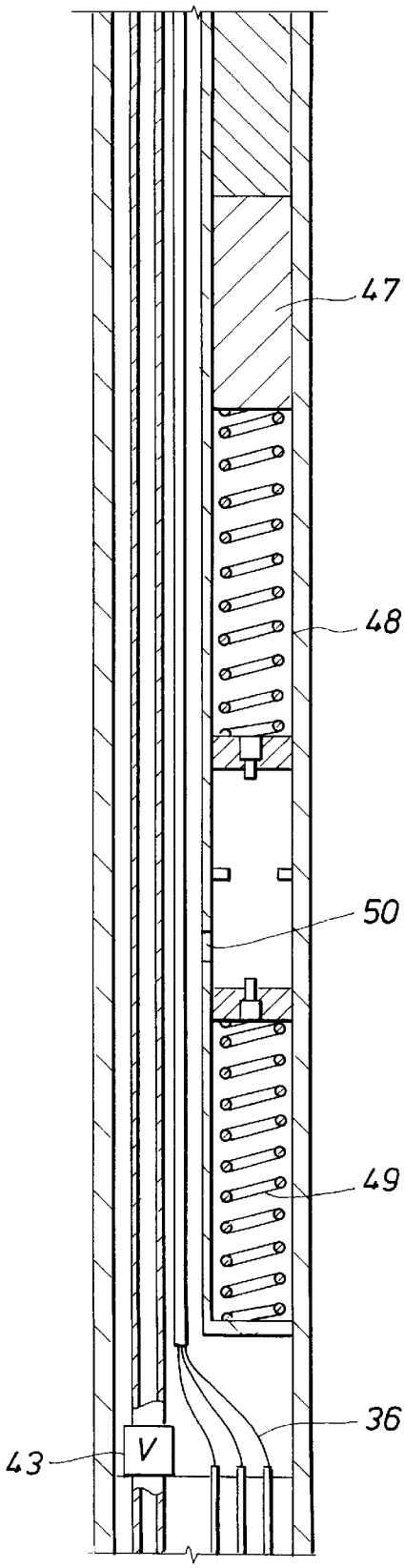
Figure 4C:
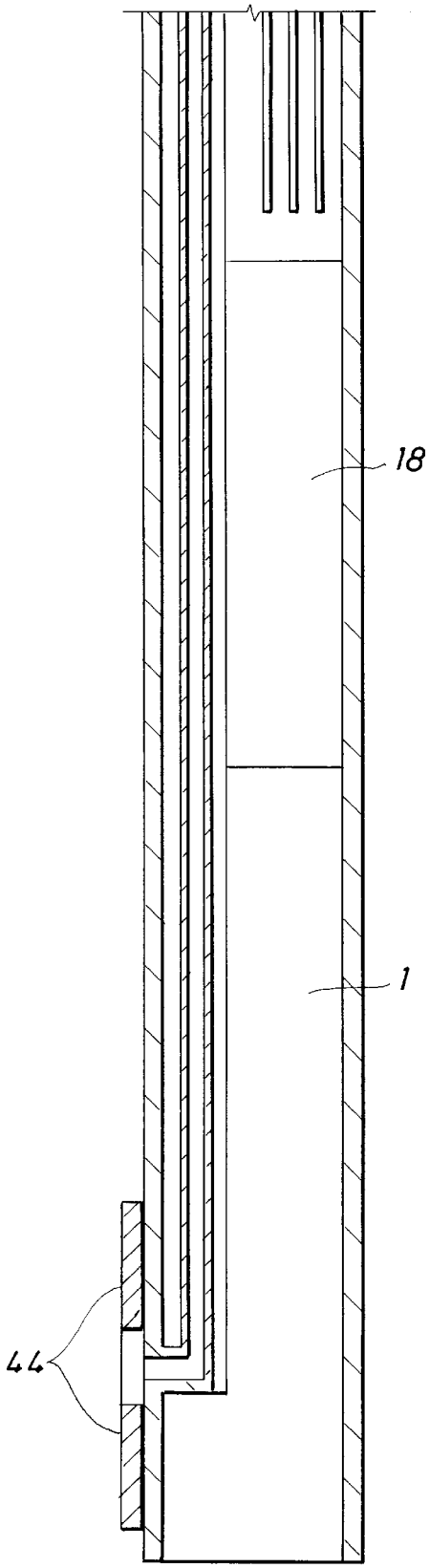

FIG. 4 shows the details of an embodiment of the present invention. Drill pipe 20 is connected to the sampling tool 1. Drilling fluid (usually drilling mud) 30 is pumped down the drill pipe 20 to lower a female electrical assembly 25 attached to a cable 21 down the drill pipe until the assembly 25 engages and latches with a down hole male electrical assembly 34 establishing contact via electrical contacts 35. Electrical wiring 36 electrically connects the downhole electrical assembly to the sampling tool. During this procedure, as the drilling fluid flows down the drill pipe the fluid pressure forces a circulation piston 40 down thereby opening a circulation port 31. Drilling fluid 30 exits the drill pipe through the opened circulation port 31. The circulation piston 40 is attached via a spring 46 to the hydraulic motor 47. As the female assembly engages the male assembly the lead portion of the female assembly (which is greater in diameter than the remaining portion of the assembly) travels pass the latch fingers 37, the fingers latch to the smaller portion of the assembly securing the two assemblies together. Centralizers 38, which are spaced 120° apart mechanically keep the female assembly 25 centralized in the docking head assembly 39 and properly aligned during the latching process to assure ease of latching the female and male assemblies. The latching procedure establishes electrical communication between the sampling tool and the surface equipment via wires 36. After the electrical contacts have latched, pumping fluid down the drill pipe ceases. At this point, springs 46 force the circulation piston 40 up to the initial position, thereby closing the circulation ports 31. With the electrical communication established and the circulation ports closed, the system is ready to begin formation fluid sampling operations.

In this description, packers 44 seal off a portion of the formation and the tool begins the sampling process. Hydrostatic pressure in the drill pipe can be lowered to provide an initial "draw down pressure" (pressure drop). A flowline 23 from the tool 1 to the drill pipe 20 is opened via flowline shut-of valve 43. The flowline shutoff off valve in the downhole electrical assembly opens the flowline to allow fluid communication from the drill pipe to the sampling tool 1. The formation sample will begin to flow through the flowline from the formation through the toolstring and downhole electrical assembly and exits the flowline at the exit port 33 and into the drill pipe 20. When contamination levels in the formation fluid are reduced to an acceptable and desirable level, formation fluid is diverted into a sample chamber.

At the completion of the sampling operation, the flowline shut-off valve 43 is closed to isolate the toolstring flowline from the downhole electrical assembly flowline 23. The sampling tool probe or packers are retracted. The contaminated fluid stored in the drill pipe now has to be moved to the surface. In order to bring the fluid to the surface, the hydrostatic pressure differential between the drill pipe and annuals 13 are equalized. The downhole electrical assembly hydraulic cylinder 42 is activated and the circulation piston 40 is pull down uncovering the circulation ports 31. In order to bring the contaminated fluid to the surface, fluid is pumped down the borehole alongside the drill pipe. The opened circulation port allows the fluid to enter the drill pipe below the contaminated fluid.

The contaminated formation fluid is recovered from the drill pipe by reverse circulating mud or fluid. Reverse circulation is accomplished by pumping mud down the annuals through the mud circulation ports 31 in the docking head 39 and up through the drill pipe 20.

The system that controls the movement of the circulation piston 40 has hydraulic cylinder 42 that contains a hydraulic piston which is moved back and forth by pumping hydraulic oil either above or below it. The hydraulic piston is connected to the circulation piston 40 which opens and closes the circulation port when the electric motor and hydraulic pump 47 are activated. This operation is needed for the reverse circulation function. A hydraulic system compensator 48 allows the hydraulic oil needed for the hydraulic pump and electric motor to be pressurized to the same pressure as the mud pressure inside the drill pipe. This compensator consists of the compensator piston and a pop-off valve and spring. This compensator provides electrical and mechanical reliability. A Silicon oil system compensator 49 allows Silicon oil needed for the male contacts and associated wiring to be pressurized to same pressure as the mud (fluid) pressure in the drill pipe. This system also consists of a compensation piston, pop-off valve and spring. This system provides electrical reliability. A mud compensation port 50 allows mud pressure from inside the drill pipe to be applied to the hydraulic system compensating piston and the silicon compensating system. This allows both systems to be pressure compensated.

The present invention also enables a testing and sampling tool to be used in a horizontal borehole. As shown in FIG. 5, stands of drill pipe 20 and 20*a* are attached to each other and extended into the borehole. The borehole bend 35 is of an angle that is wide enough to allow the connected drill pipe to extend through the bend. The tool 1 is attached to the drill pipe as in vertical borehole operations. The support of the tool by the drill pipe enables the tool to take measurements of the formation by the probe 4 in the shown position. This particular measurement would not be possible using only a conventional wireline 21 and associated equipment.

The method and apparatus of this invention provides significant advantages over the current art. The invention has been described in connection with its preferred embodiment. However, it is not limited thereto. For instance a multi-sample storage chamber can be implemented with this invention. The tool string could use IRIS, a tubing tester valve, annular sample jars. If necessary, the tool could be hung off with EZ Tree. The actual configuration would like other tools would depend needs of a specific job. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of the invention which is limited only by the following claims.

We claim:

1. A downhole system for measuring and determining earth formation properties, comprising:

(a) a multi-purpose downhole tool deployed in a borehole for obtaining data regarding earth formation fluid properties, said tool having upper and lower ends;

(b) a storage chamber attached to the upper end of said tool for supporting said tool and storing formation fluid retrieved by said tool, said storage chamber having a circulation port therein;

(c) a fluid control means in said chamber to control fluid flow through the circulation port; and (d) flowlines in said downhole tool for establishing fluid communication between the formation, said downhole tool and said storage chamber.

2. The system of claim 1 wherein said tool comprises an electrical power module at the upper end of said tool.

3. The system of claim 2 further comprising a downhole electrical contact attached to the electrical power module.

4. The system of claim 3 further comprising a pump down electrical contact attached to a cable, said pumpdown electrical contact being capable of latching with said downhole contact and establishing electrical communication between said tool and surface equipment via said cable.

5. The system of claim 1 wherein said storage chamber is comprised of drill pipe.

6. The system of claim 1 wherein said tool has a dual packer module and a probe that establish contact with said earth formation and can retrieve fluid from said earth formation.

7. The system of claim 6 further comprising a pump contained in said tool to pump fluid from said formation into said tool and a fluid analyzer contained in said tool to analyze fluid from said formation.

8. The system of claim 7 wherein said tool further comprises a second fluid storage chamber at said lower end of said tool.

9. The system of claim 8 wherein said second storage chamber can be a plurality of storage chambers.

10. The system of claim 1 wherein said control means is a circulation valve located in said circulation port.

11. The system of claim 1 wherein said storage chamber has a side opening at some point in the chamber to allow a cable to pass out of the chamber and into the borehole.

12. The system of claim 1 wherein said storage chamber is comprised of coil tubing.

13. The system of claim 1 wherein said tool has a dual packer module that establishes contact with said earth formation and can retrieve fluid from said earth formation.

14. The system of claim 1 wherein said tool has a probe that establishes contact with said earth formation and can retrieve fluid from said earth formation.

15. A downhole system for obtaining formation fluid samples, comprising:

(a) a tool means for deployment in a borehole traversing an earth formation to obtain data regarding earth formation fluid properties, said tool means having upper and lower ends;

(b) a storage means attached to the upper end of said tool means for supporting said tool means, said storage means having an opening to allow a cable to pass out of said storage means and into the borehole;

(c) a control means including a circulation port in said storage means to control fluid flow between said storage means and borehole; and (d) a means in said tool means that establishes fluid communication between said tool means, said storage means and the formation.

16. The system of claim 15 further comprising a means for supplying electrical power to said tool means, said power means being at said upper end of said tool means.

17. The system of claim 16 further comprising a connecting means attached to said power means for connecting said tool means to said cable and establishing electrical communication between said tool means and surface equipment via said cable.

18. The system of claim 17 wherein said connecting means has a downhole portion that is attached to the power means and an uphole portion attached to said cable, said downhole and uphole portions latch together to form a contact for transmission data between said tool means and the surface equipment.

19. The system of claim 18 further comprising in said tool means, a means to retrieve fluid from said formation and a means to analyze said fluid to determine a contamination level of said fluid.

20. The system of claim 18 further comprising a fluid retrieval means to bring retrieved contaminated fluid stored in said storage means to said earth formation surface.

* * * * *